US006461206B2

(12) United States Patent
Small et al.

(10) Patent No.: US 6,461,206 B2
(45) Date of Patent: Oct. 8, 2002

(54) IMPACT RUDDER

(75) Inventors: Mark S. Small, Delray Beach, FL (US); David Gruenwald, Butte des Morts, WI (US)

(73) Assignee: Power Vent Technologies, Inc., Pompano Beach, FL (US)

( * ) Notice: Subject to any disclaimer, the term of this patent is extended or adjusted under 35 U.S.C. 154(b) by 0 days.

(21) Appl. No.: 09/770,145

(22) Filed: Jan. 25, 2001

(65) Prior Publication Data

US 2002/0098749 A1 Jul. 25, 2002

(51) Int. Cl.[7] ..... B63H 5/16
(52) U.S. Cl. ..... 440/69
(58) Field of Search ..... 440/38, 40, 43, 440/66, 68, 69

(56) References Cited

U.S. PATENT DOCUMENTS

| | | | | | |
|---|---|---|---|---|---|
| 3,422,788 | A | * | 1/1969 | Horan, Jr. | 440/43 |
| 3,976,026 | A | * | 8/1976 | Eastling | 440/43 |
| 4,689,026 | A | | 8/1987 | Small | |
| 5,387,141 | A | * | 2/1995 | Toyohara et al. | 440/41 |
| 5,437,568 | A | * | 8/1995 | Kobayashi | 440/38 |
| 6,045,420 | A | | 4/2000 | Small et al. | |

* cited by examiner

*Primary Examiner*—Ed Swinehart
(74) *Attorney, Agent, or Firm*—McHale & Slavin

(57) ABSTRACT

A rudder for a water craft is constructed to automatically compensate for impact on the rudder while the craft is maneuvering. The lower portion of the rudder is mounted to an upper portion by a pin. The lower portion can pivot about the pin to reduce drag and draft. The lower portion is spring loaded to return to the original position after impact.

8 Claims, 3 Drawing Sheets

IMPACT RUDDER

FIELD OF THE INVENTION

The present invention relates to the field of water craft, namely to the design of rudders used for contributing to directional control of water craft. This invention, in particular, relates to a self compensating mechanism for automatically adjusting/retracting a portion of a rudder in response to impacts during maneuvering of the boat.

BACKGROUND OF THE INVENTION

The draft of boats are dictated by hull design features. In conventional construction, the drive gear is suspended below the hull. So the overall draft of a boat normally includes the distance from the waterline to the keel plus the space required by the drive gear. The rudder remains the conventional device for providing directional control under way in standard boat designs. As such, the rudder must be immersed in the water and have water flow across the control surface. However, the rudder increases the draft of the boat and increases drag. Typically, at least a portion of a rudder forms the lowermost point of the draft. A sudden impact to a rigid rudder may damage the directional control of the craft and possibly render the boat unseaworthy.

Water craft that operate in coastal or inland water ways are especially prone to rudder damage due to shallow water operation. In this area of operation, contact with the bottom of the waterway is always a possibility. Further, debris in the water poses a hazard for any water craft, regardless of the speed of the boat or depth of the water. The force of impact with such obstacles may irreparably damage the rudder and possibly render the vessel uncontrollable and unseaworthy.

In certain specialized hull designs having extremely shallow draft, the drive gear is located in a tunnel formed in the bottom of the boat. In these craft, the drive gear may be partially below the plane of the keel, on the same plane as the keel or even above the plane of the keel. Included in this specialized class are boats designed for high speeds with super cavitating propeller(s) such as those disclosed in U.S. Pat. No. 4,689,026 and U.S. Pat. No. 6,045,420; the contents of which are incorporated herein by reference. At high speed, the changing water conditions may result in sudden impacts on the rudder.

Thus, what is lacking in the art is a teaching of a rudder that will pivot or tilt to reduce drag and draft to compensate for various impacts while underway and automatically return to its original position.

SUMMARY OF THE INVENTION

A rudder for a water craft constructed to automatically compensate for impact on the rudder while the craft is maneuvering. The lower portion of the rudder is mounted to an upper portion by a pin. The lower portion can pivot about the pin to reduce drag and draft. The lower portion is spring loaded to return to the original position after impact.

Accordingly, it is an objective of the instant invention to provide a rudder that can compensate for sudden impacts during maneuvering without losing directional control.

It is a further objective of the instant invention to provide a two part rudder in which the lower portion is foldable into the upper portion to reduce draft.

It is yet another objective of the instant invention to provide a rudder which will automatically return the lower portion to its original position upon release of resistence.

It is a still further objective of the invention to provide a rudder in which the upper portion and lower portion are spring loaded in the original position and the resilience of the spring returns the lower portion to the original position when it is displaced by the force of an impact.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE INVENTION

Figure 1:
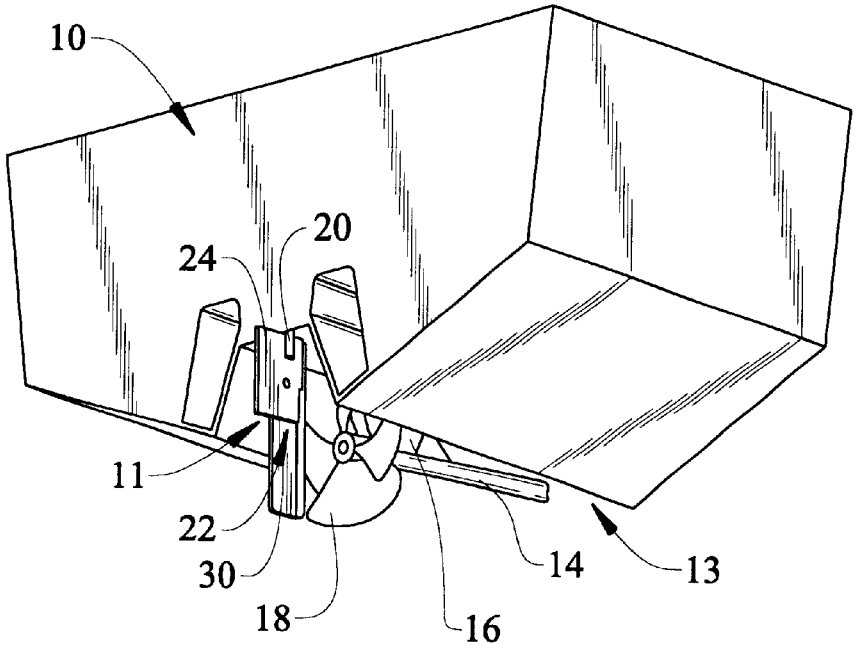
FIG. 1 is a perspective view of the stern of a boat showing a rudder of this invention.

In FIG. 1, the boat 10 is shown with a tunnel 11, along the keel 13, partially enclosing the drive gear. The propulsion system includes a propeller shaft 14 leading from the engine and or transmission (not shown). The shaft is stabilized by struts 16 and 17 and carries propeller 18. The propeller 18, shown in FIG. 1, is a super cavitating propeller used in high speed boats. The directional control system includes the rudder post 20 connected to the steering gear (not shown) for moving the impact rudder 22.

Figure 6:
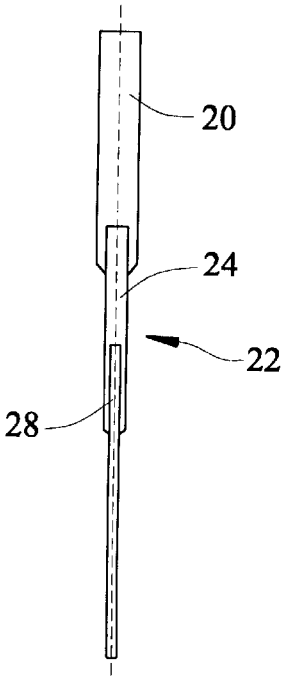
FIG. 6 is an end view of a rudder of this invention.

In FIG. 1, the rudder 22 is depicted in the drawings as having a rectilinear shape however, this is illustrative only. This invention is not directed to the shape of the rudder, however the construction of this rudder may be applied to variously shaped rudders. The upper body 24 of the rudder 22 is fixed to the rudder post 20 in such a manner as to prevent relative movement between them. The upper body 24 has a leading edge 25, a bottom edge 26, and a trailing edge 27. The trailing edge 27 and the aft portion of the bottom edge 26 (shown in FIG. 6) have a longitudinal slot 28 which defines the opening into an interior cavity 29, shown in FIGS. 3 and 4. The lower body 30 of the rudder 22 is mounted on the upper body 24 by a pin 31. The lower body also has a leading edge 32, a bottom edge 33 and a trailing edge 34. The lower body 30 rotates about the pin 31 to compensate for any impact on the leading edge 32 of the rudder. After impact, the lower body 30 returns to its original position through resilient action of the spring 35.

Figure 2:
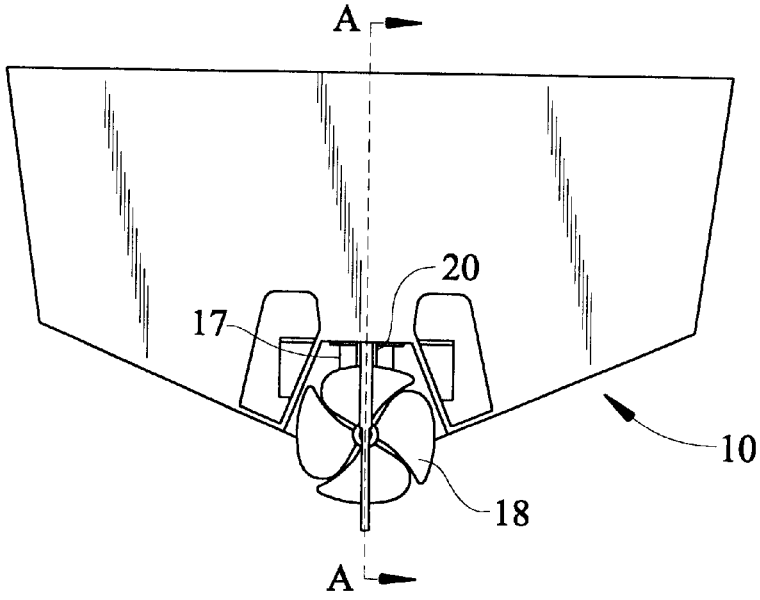
FIG. 2 is a stern view of a boat and a rudder of this invention.

FIG. 2 illustrates the rudder having a bottom edge terminating approximately coplanar with the propeller arc and the bottom of the propeller 18, respectively.

In internal cavity 29 of the upper body 24, the side walls are separated to allow free swinging movement of the top part of the lower body 30 as it rotates about pin 31. The spring may take several different forms, such as coil or leaf, and may be resiliently loaded through expansion or compression.

Figure 3:
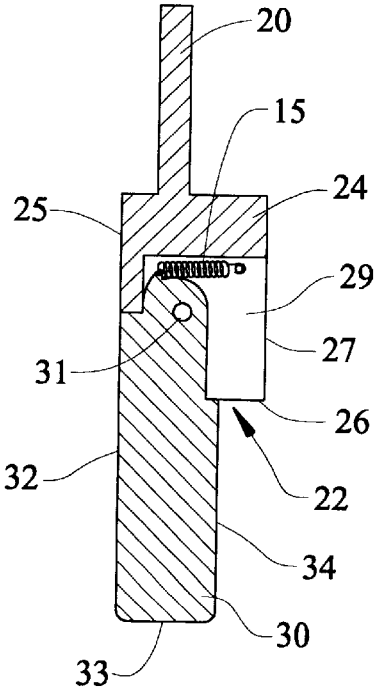
FIG. 3 is a cross section along line A—A of FIG. 2.
Figure 4:
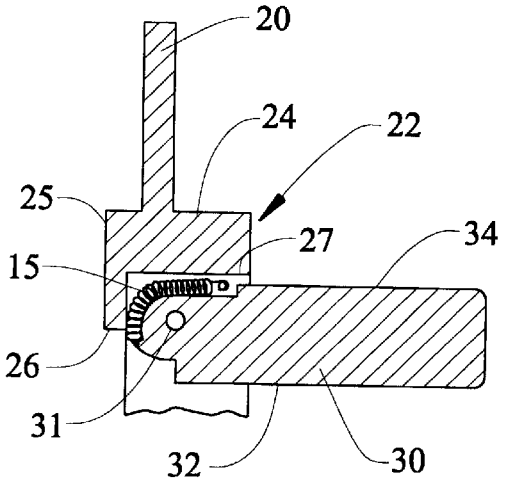
FIG. 4 is another cross section of the rudder of FIG. 3 in the impact position.
Figure 5:
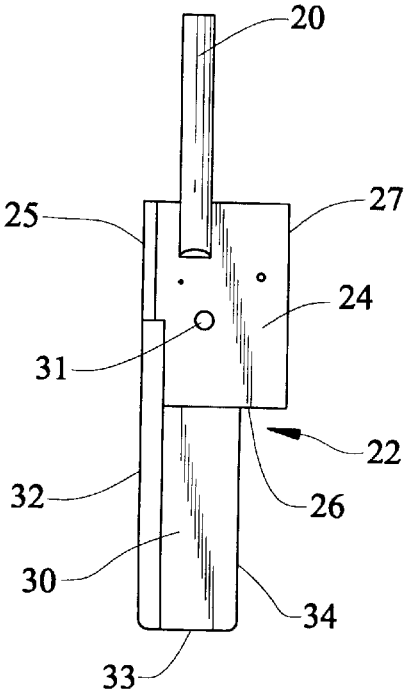
FIG. 5 is a side view of a rudder of this invention.

In FIG. 3, the coil spring 15 is shown in the retracted position with the rudder in the normal running position. In FIG. 4, the spring 15 is shown extended and under resilient tension with the lower body 30 of the rudder in the impact position. When the rudder disengages from any obstruction it has encountered, the spring tension will return the lower body of the rudder to the normal position.

Figure 7:
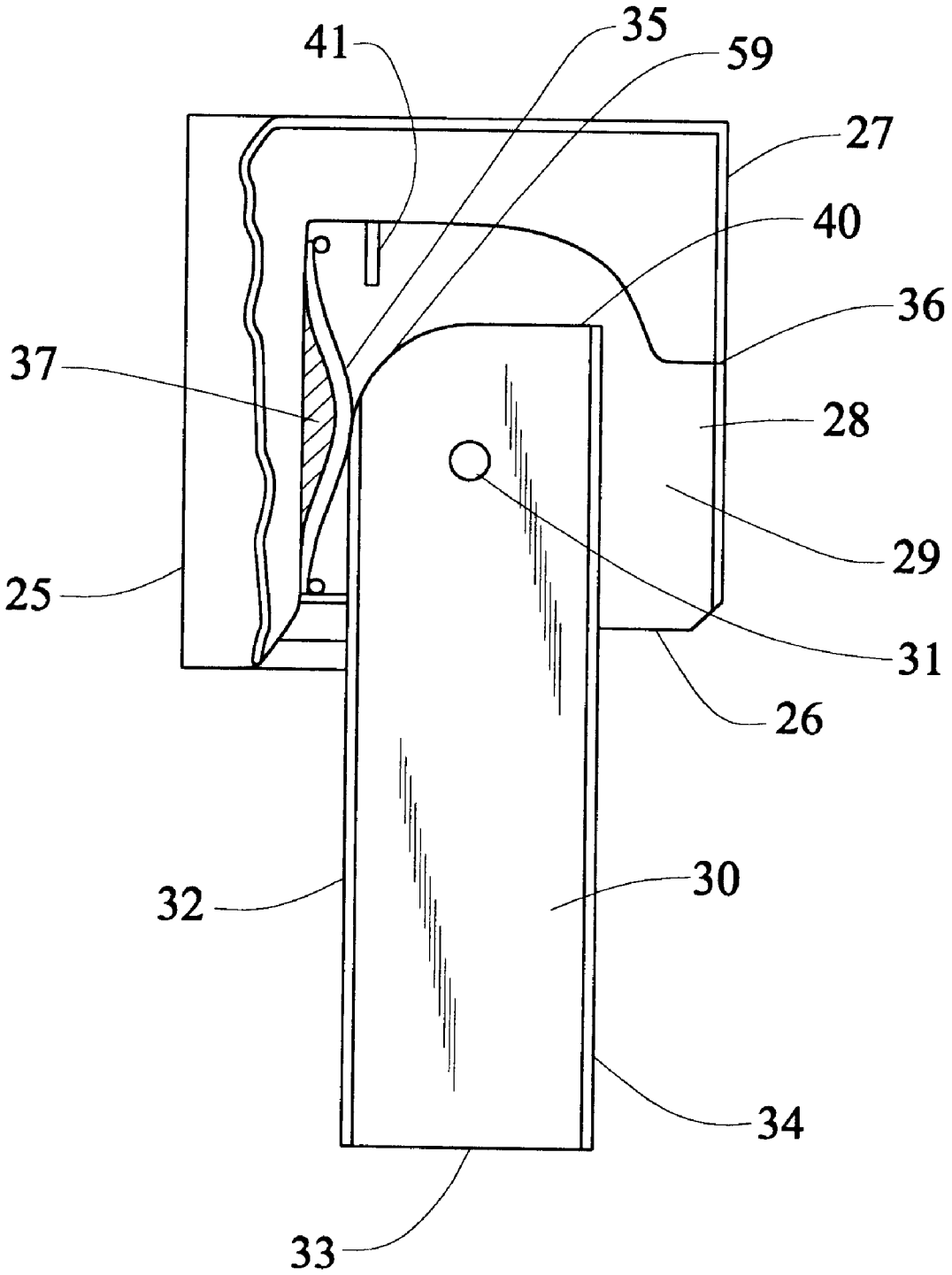
FIG. 7 is a cross section showing another rudder spring.

As shown in FIG. 7, the spring 35 is a leaf spring loaded by compression as the cam edge 39 of the upper body rotates toward the leading edge 25 of the upper body in response to an impact on the lower body. The spring 35 has a stop 37 to prevent over center extension of the spring. The upper edge 36 of the slot 28 engages the trailing edge 34 of the lower body and serves as a stop for rotation of the lower body. Also, the trailing top edge 40 of the lower body will engage the partial wall 41 in side the cavity to provide a positive stop f or the rotation of the lower body. Either or both of these stop surfaces may be used to limit the rotation of the lower body. Obviously, a spring or springs could be mounted on the opposite side of the lower body and operate in reverse phase to the illustrated operation.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

What is claimed is:

1. In a boat having a hull, said hull formed with at least one tunnel, a propulsion system having a propeller shaft connected to a propeller disposed in said tunnel, with said propeller providing the sole source of forward movement, and a rudder providing the sole source of directional control, said rudder depending from said hull in said tunnel, said rudder comprising an upper body and a lower body, said upper body connected to said directional control system, said lower body is rotatably connected to said upper body at a pivot point, said pivot point being spring loaded whereby in response to an impact upon said lower body said lower body rotates about said pivot point.

2. In a boat of claim 1 wherein said pivot point includes a spring, said spring providing resilient force to maintain said upper body and said lower body in an at-rest position.

3. In a boat of claim 2 wherein said spring is loaded as said lower body rotates about said pivot point in response to said impact, said spring automatically unloading to return said lower body to said at-rest position after impact.

4. In a boat of claim 3 wherein said upper body has a periphery comprising a leading edge, a bottom edge and a trailing edge, said trailing edge containing a slot, said lower body mounted in said slot and extending below said bottom edge of said upper body, and said spring located in said slot between said upper body and said lower body whereby said lower body rotates into said slot upon impact.

5. In a boat of claim 3 wherein said boat has a keel and said upper body terminates approximately coplanar with said keel.

6. A boat of claim 1 wherein said propeller is a super cavitating propeller.

7. In a boat having a hull with a keel, a propulsion system, said propulsion system having a propeller shaft and a propeller secured to said shaft, said propeller depending below said keel, and a directional control system including a depending rudder, said rudder comprising an upper body and a lower body, said upper body connected to said directional control system, said lower body rotatably connected to said upper body at a pivot point, said pivot point includes a spring, said spring providing resilient force to maintain said upper body and said lower body in an at-rest position, said spring loaded as said lower body rotates about said pivot point in response to said impact, said spring automatically unloading to return said lower body to said at-rest position after impact whereby in response to an impact upon said lower body said lower body rotates about said pivot point, said upper body terminating approximately coplanar with said propeller.

8. In a boat having a hull, a propulsion system and a directional control system including a depending rudder, said rudder comprising an upper body and a lower body, said upper body connected to said directional control system, said lower body is rotatably connected to said upper body at a pivot point whereby in response to an impact upon said lower body said lower body rotates about said pivot point, said pivot point includes a spring, said spring providing resilient force to maintain said upper body and said lower body in an at-rest position, said spring loading as said lower body rotates about said pivot point in response to said impact, said spring automatically unloading to return said lower body to said at-rest position after impact wherein said propulsion system has a propeller shaft with a super cavitating propeller secured to said shaft, said pivot point approximately coplanar with said propeller shaft.

* * * * *